US005676374A

United States Patent [19]

Bossa et al.

[11] Patent Number: 5,676,374

[45] Date of Patent: Oct. 14, 1997

[54] TOY STAIRCASE GAME APPARATS AND METHOD

[75] Inventors: David W. Bossa, Braintree; Christopher A. Down; Edward J. Estabrook, both of Beverly, all of Mass.; Ralph J. Kulesza, Chicago; Wayne A. Kuna, River Forest, both of Ill.

[73] Assignee: Hasbro, Inc., Pawtucket, R.I.

[21] Appl. No.: 635,146

[22] Filed: Apr. 23, 1996

[51] Int. Cl.[6] ..... A63F 3/00

[52] U.S. Cl. ..... 273/237; 273/249; 273/287; 273/283; 273/241; 463/65; 463/69; 446/314

[58] Field of Search ..... 273/241, 243, 273/249, 287, 237, 283; 463/65, 67; 446/314, 424, 171

[56] References Cited

U.S. PATENT DOCUMENTS

| | | | |
|---|---|---|---|
| 2,013,568 | 9/1935 | Mallard | 446/314 |
| 2,218,164 | 10/1940 | Carpenter | 463/59 |
| 3,045,393 | 7/1962 | Knott | 446/135 |
| 3,720,412 | 3/1973 | Ramirez | 273/441 |
| 3,721,036 | 3/1973 | Goldfarb | 446/314 |
| 4,147,359 | 4/1979 | King | 273/241 |
| 4,666,162 | 5/1987 | Campbell | 273/249 |
| 4,728,312 | 3/1988 | Ohnuma | 446/314 |
| 4,740,185 | 4/1988 | Inglee | 446/2 |
| 4,778,430 | 10/1988 | Goldfarb et al. | 446/167 |

FOREIGN PATENT DOCUMENTS

| | | |
|---|---|---|
| 468002 | 11/1928 | Germany . |
| 1167286 | 3/1987 | Italy . |
| 2 150 448 A | 7/1985 | United Kingdom . |

*Primary Examiner*—Benjamin H. Layno

*Attorney, Agent, or Firm*—Marshall, O'Toole, Gerstein, Murray & Borun

[57] ABSTRACT

The game disclosed includes a movable staircase assembly that moves characters from one location on the staircase assembly to another. A spinner directs a player to place a character on the staircase at a specific location, to skip a turn, or remove an opposing player's character from the staircase. The winner is the first player to have all of her characters reach the end of the staircase. The staircase includes stationary and movable components that serially move the characters from one step to the next with a reciprocating motion of the movable component relative to the stationary component. A gear mesh and cam converts the rotary motion of a battery-operated motor to a reciprocating motion in the movable component.

29 Claims, 5 Drawing Sheets

TOY STAIRCASE GAME APPARATS AND METHOD

This invention relates generally to mechanized toy staircases for lifting objects and more specifically to a children's game incorporating a toy staircase assembly that is simple and inexpensive to build and is connectable with other such staircase assemblies to lift objects using a single drive mechanism.

BACKGROUND OF THE INVENTION

Toy staircase assemblies are known for raising objects from a low position to a high position and depositing them on a slide or a turntable for a return trip to the low end of the staircase assembly.

For example, Goldfarb, U.S. Pat. No. 3,721,036 and U.K. Publ. No. 2,150,448A both disclose mechanized toy staircases which use pairs of movable staircase plates sandwiched between pairs of stationary staircase plates that support outwardly extending links of a character or vehicle being elevated on the stairs. The movable staircase plates are oscillated to raise and lower an object to successively higher steps. Because these assemblies require the use of two movable staircase plates and two stationary staircase plates to raise the objects with outwardly extending links, they require more parts, are more expensive to assemble, and provide numerous locations for debilitating friction and jams to occur.

Another disclosure of a mechanized staircase assembly is in Ohnuma, U.S. Pat. No. 4,728,312, which is similar to the previously described staircases, except that Ohnuma uses a pair of movable staircase plates that alternate in their respective oscillating motions to lift an object up two stairs for every single rotation of a motor. Again, complex assemblies are required which provide additional opportunities for wear, mechanical breakdown, and jams.

Further, none of the prior toy staircase assemblies can be joined with other toy staircase assemblies to form a series of stepped elevating mechanisms joined by intermediate slides for delivering a character to the low end of an adjacent staircase assembly. Certainly, none of the prior disclosures contemplated the use of a series of staircase assemblies driven by a single motor and gear mesh. Nor did any of the prior staircase patent disclosures teach the use of a staircase for use in a children's game.

Thus, there is a need for a toy staircase assembly that is simple in construction and operation to save assembly time and costs to the consumer. Moreover, it would be desirable to link up a series of mechanical staircases with intermediate slides that deliver a character from the top of one staircase to the bottom of an adjacent staircase. When using staircase assemblies in series it would be most desirable to drive them all with a single mechanism. Finally, it would be desirable to use a staircase assembly in a children's game. The present invention satisfies these goals.

SUMMARY OF INVENTION

A game for use with a toy staircase assembly in accordance with the present invention comprises: a base, a stationary staircase joined to the base, having a starting position and a plurality of stationary stairs ascending from a lower portion to a higher portion of the stationary staircase, the stationary stairs each including a riser and a tread; a movable staircase having a plurality of movable stairs ascending from a lower portion to a higher portion of the movable stairs, each movable stair including a riser and a tread; a plurality of objects each having means for straddling the staircase assembly and for sitting on the tread of a stationary stair and the tread of a movable stair; reciprocating means for raising the movable staircase to engage an object with a movable stair, raise it over a riser of an adjacent and higher stair, and lower it onto the tread of the adjacent and higher stationary stair; chance means for directing a player to make a move with instructions selected from the group comprising, placing an object on the staircase starting point, skipping a turn, and removing an opposing player's object from the staircase; whereby game rules require activation of the reciprocating means, instruct each player to obtain a like number of objects having a distinctive feature, and, in turn, operate the chance means and make moves until all of the objects of one player have ascended the staircase to the end.

A staircase assembly in accordance with the present invention includes: a first staircase subassembly; a second staircase subassembly joined to the first staircase subassembly; each staircase subassembly comprising: a base; a stationary staircase joined to the base, having a plurality of stationary stairs ascending from a lower portion to a higher portion, and each stationary stair including a riser and a tread; and a movable staircase operatively joined to and adjacent the stationary staircase and having a plurality of movable stairs ascending from a lower portion to a higher portion of the movable staircase, each movable stair comprising a riser and a tread; the staircase assembly further includes a descending slide coplaner with the stationary staircase of the first staircase subassembly and having means for receiving an object from the movable staircase of the first staircase subassembly and slidably transferring an object downward to a lower portion of the second staircase subassembly; and reciprocating means for raising the movable staircase to engage an object sitting on a tread of a stationary stair, lifting the object over a riser of an adjacent and higher stationary stair, and for lowering the movable staircase to set the object on the tread of the adjacent higher stair.

Another toy staircase assembly in accordance with the present invention may include: a base; a single stationary staircase joined to and extending upwardly from the base, having a plurality of stationary stairs ascending from a lower portion of the stationary staircase, each stationary stair including a riser and a tread; a single movable staircase operatively joined to and adjacent the stationary staircase, and having a plurality of movable stairs ascending from a lower portion of the movable staircase to a higher portion of the movable staircase, each movable stair comprising a riser and a tread; an object having means for straddling the stationary staircase and the movable staircase simultaneously, and for sitting on a tread of a stationary stair and a tread of a movable stair; and reciprocating means for raising the movable staircase to engage the object sitting on a tread of a stationary stair with a movable stair to raise the object over the riser of an adjacent higher stationary stair, and for lowering the movable staircase to set the object on the tread of an adjacent higher stair. Further, second and third staircase assemblies can be added which are all driven by a single reciprocating means.

DETAILED DESCRIPTION OF THE DRAWINGS

To the extent practical, the same or similar element will be referenced by the same numeral in each of the figures.

Figure 1:
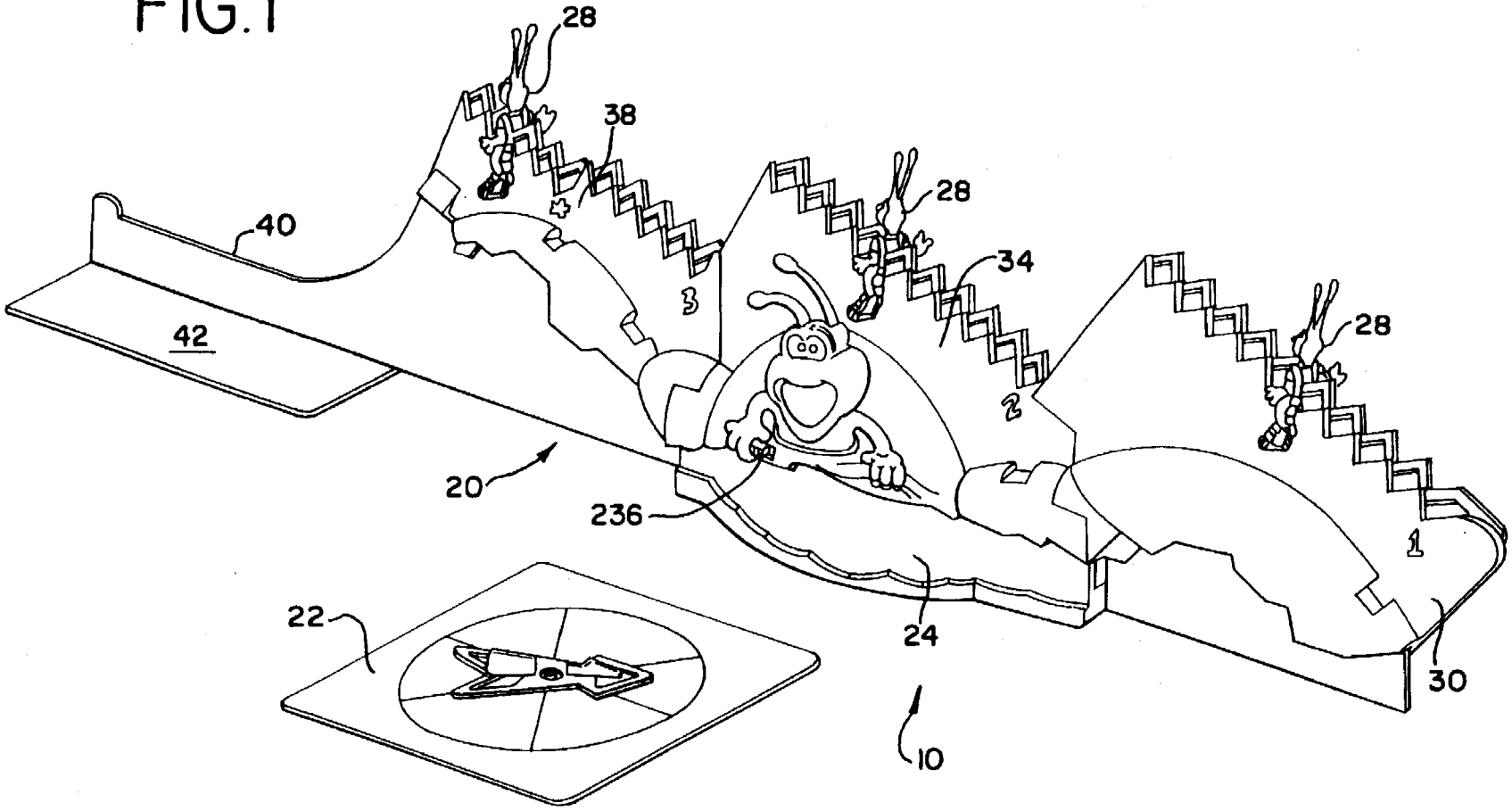
FIG. 1 is a perspective view of a game including a series of three staircase subassemblies in accordance with the present invention.

Illustrated in FIG. 1 is a children's game 10 incorporating a staircase assembly 20 in accordance with the present invention. The toy 10 also includes a spinner 22, a stylized facade 24, and three characters 28 straddling the staircase assembly 20.

The staircase assembly 20 includes a first staircase subassembly 30 having a starting location on the right end labeled "1," a second staircase subassembly 4 in the middle and having a starting location labeled "2," and a third staircase subassembly 38 on the left having a starting location labeled "3." At the far left end of the staircase assembly is a descending end-slide 40. All of these components are supported in a substantially vertical position by horizontal base plate 42 and the facade 24 which bows outward from the staircase assembly 20. Stylized features on the facade 24 may be incorporated to enhance play value of the toy 10.

As will be apparent from the description below, movement of a character 28 is from the right to the left where it will slide down the end-slide 40.

Figure 2:
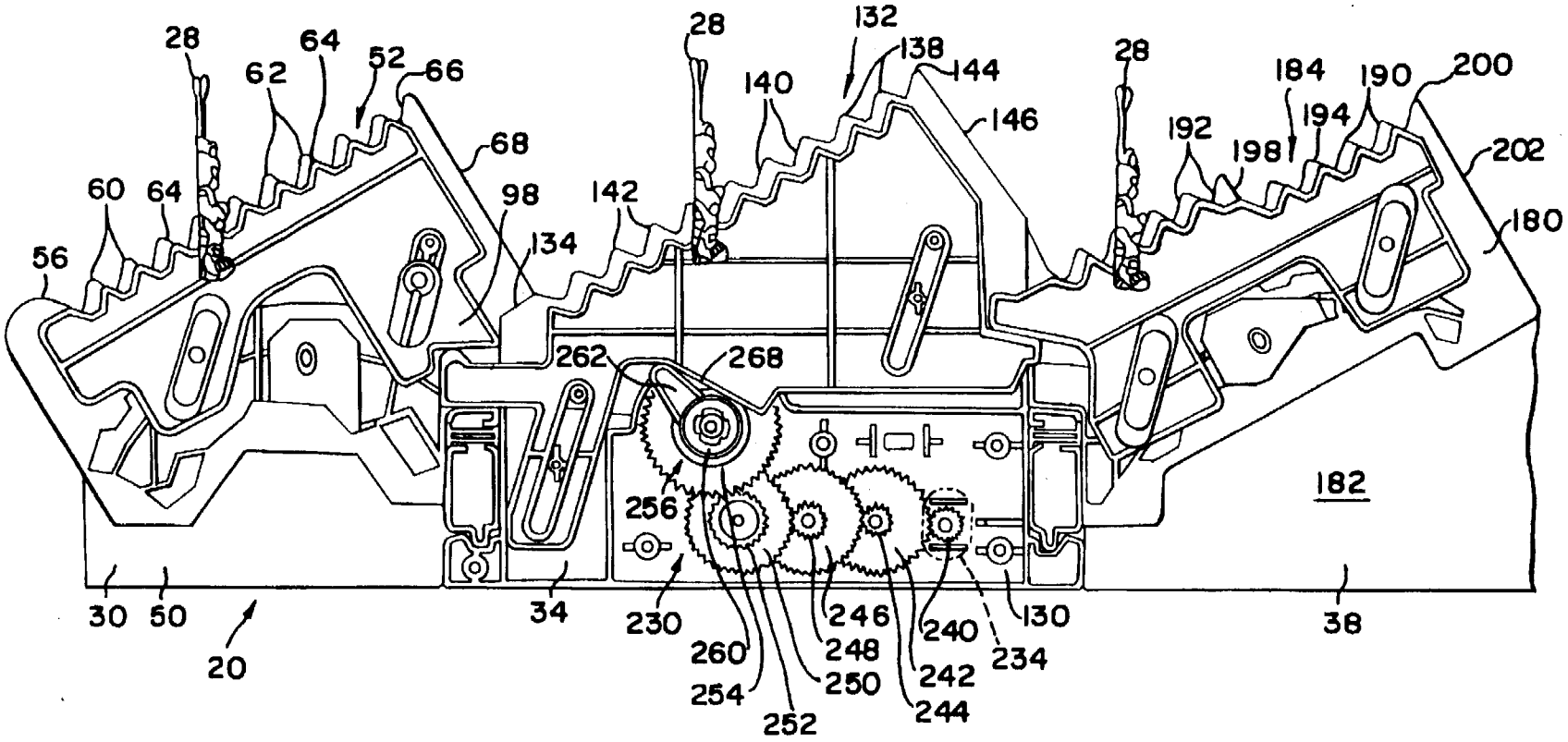
FIG. 2 is a rear elevational and partial cross-sectional view of the toy staircase illustrated in FIG. 1 with movable staircases in a lowered position.
Figure 3:
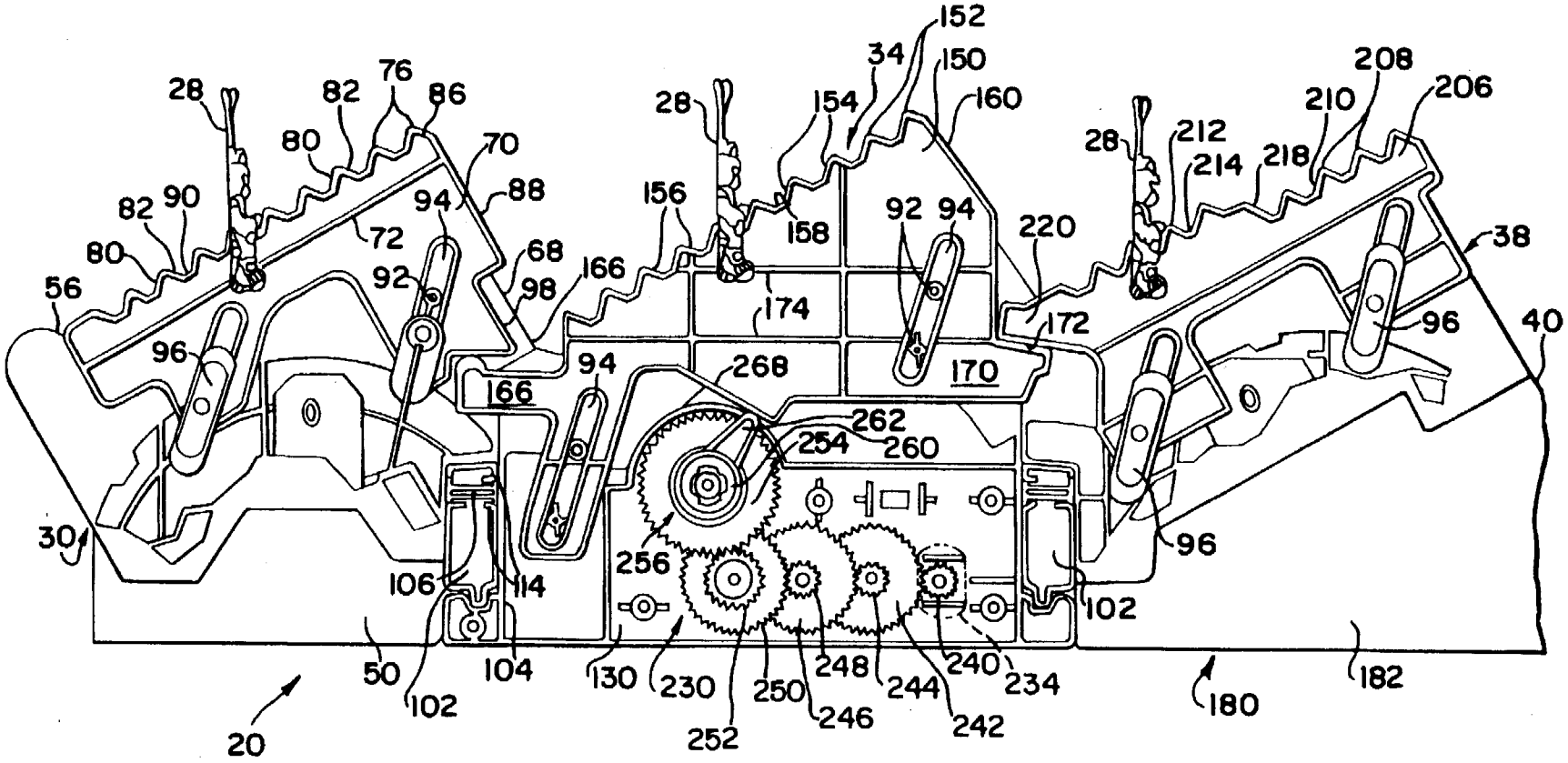
FIG. 3 is a toy staircase as illustrated in FIG. 2 except that the movable staircases are in a raised position.

Referring now to FIGS. 2 and 3, the back side of the staircase assembly 20 is illustrated with the working components exposed. Because these are rear views of the staircase assembly 20, the first staircase subassembly 30 is now on the left side and the third staircase subassembly 38 is on the right side. The end-slide 40 is not illustrated.

As illustrated in FIG. 2, the first toy staircase subassembly 30 includes a base 50 which is stationary and an upwardly extending first stationary staircase 52 that is essentially a single vertical plate and is preferably molded integrally with the base 50. At the left end of the first stationary staircase 52 is a rounded staging ramp 56 which descends from left to right and defines the first starting point "1" for the characters 28.

Ascending upward from the staging ramp 56 are a series of first stationary steps 60 which each have risers 62 and treads 64 except that the last and highest riser 66 has no corresponding tread. Instead, the last riser 66 is mated with a first descending ramp 68. The risers 66 and treads 64 are pitched at a slight angle such that the characters 28 will rest between both without slipping backward down the stairs.

As best seen in FIG. 3, positioned in front of and adjacent to the first stationary staircase 52, is a first movable staircase 70. The first movable staircase is a flat plate preferably including integrally molded stiffeners 72. Along the upper portion of the first movable staircase 70 is a series of ascending movable steps 76 with each movable step 76 including a riser 80 and a tread 82. At the end of the highest movable step tread 86 is a first movable descending ramp 88. As illustrated, the treads 82 on the movable steps 76 are spaced apart slightly from the risers 80 on the next higher step 76 by spacers 90, but otherwise the movable risers 80 and treads 82 are substantially parallel to the stationary risers and treads.

The first movable staircase 70 is slidably joined to the first stationary staircase 52 so that as the movable staircase 70 moves upward it also moves forward slightly and, conversely, will move rearward slightly when moving downward.

To accomplish this relative movement, the first stationary staircase 52 includes guide members 92. The first movable staircase 70 defines corresponding elongated guideways 94 that are ascending from left-to-right. Retainers 96 are screwed to the guide members 92 to maintain the first movable staircase 70 in close relationship to the first stationary staircase 52 while permitting relative sliding movement between the two. The upper guide members 92 limit the extent of downward travel by the first movable staircase 70.

At the right side of the first movable staircase 70 is a triangularly-shaped lifter 98 that will be engaged by a corresponding element on an adjacent movable staircase as described below so that the two adjacent movable staircases will move in unison.

Figure 4:
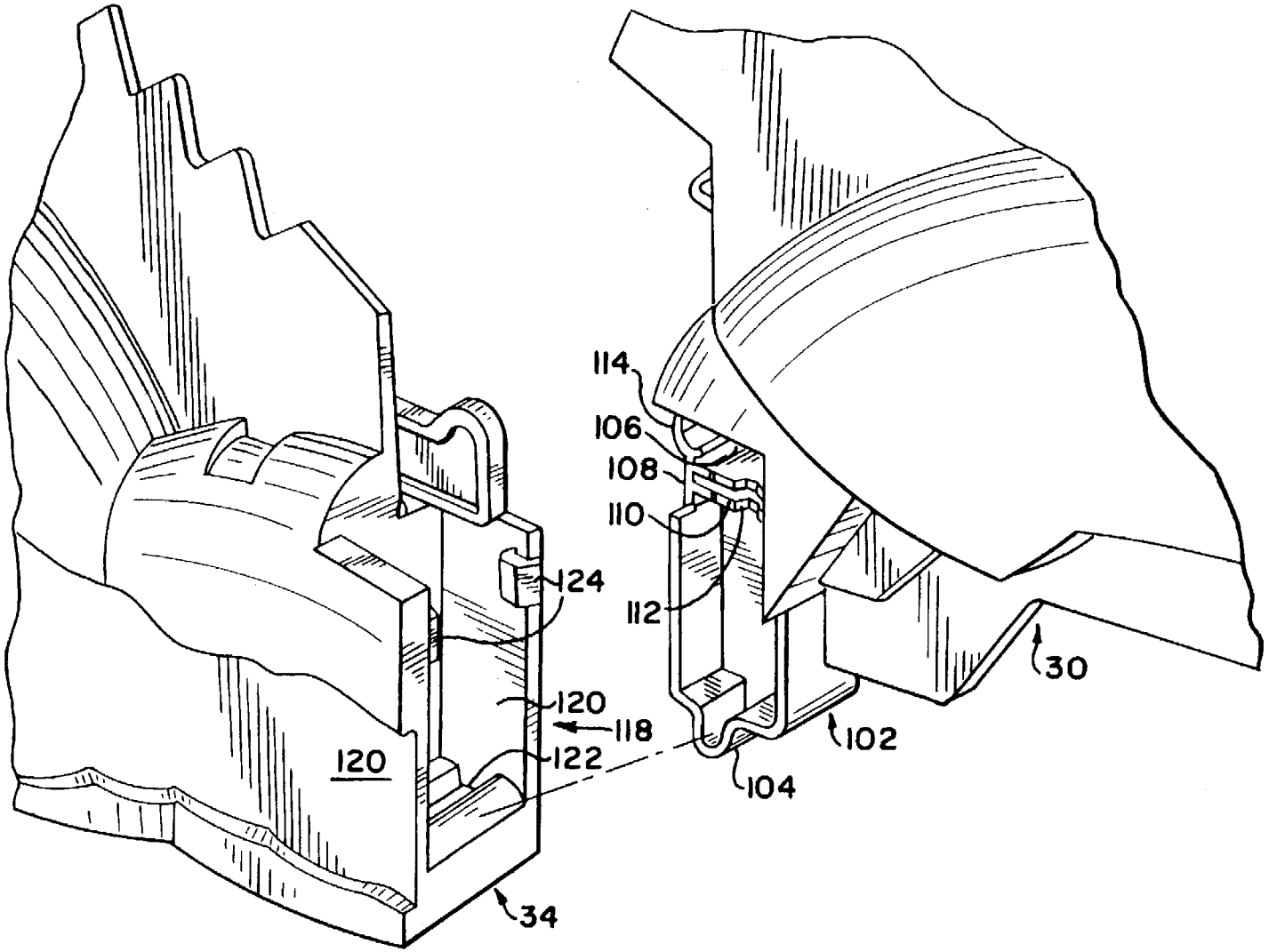
FIG. 4 is a partial perspective view of a connector for joining adjacent staircase subassemblies.

Finally with respect to the first staircase subassembly 30, and illustrated in FIG. 4 from the front of the toy 10, there is a male connector element 102 that has a transverse pivot rib 104 along the bottom and a pair of ramped bearing ribs 106 which are on both sides of the subassembly 30, but only visible on one side as illustrated. The ramped bearing ribs 106 extend transversely sideways from both sides of the first subassembly 30 and include a ramp 108 as illustrated, a flat portion 110, and a rear detent 112. Tapered guides 114 are also provided to ease assembly of adjacent subassemblies.

The matching female connector element 118 on an adjacent subassembly includes sidewalls 120 and an elongated transverse recess 122 positioned in the bottom of the female connector 118 to receive the male pivot 104. Protruding inwardly from each sidewall 120 is a snap element 124 sized and positioned to interact with the male bearing ribs 106.

To connect adjacent subassemblies, the male pivot 104 is first inserted into the female recess 122. The subassemblies then are pivoted to engage the male bearing ribs with the female snaps 124 so that the snaps 124 ride up the ramps 108, over the flats 110, and snap into the detents 112 due to the resiliency of the female side walls 120. The connector elements are preferably wide relative to the staircases to provide strength and resistance to the subassemblies twisting apart laterally. This connector is preferred, but others will work adequately.

Referring back to FIG. 2, the second subassembly 34 includes a base housing 130 and a second stationary staircase 132. The left edge of the second stationary staircase 132 is shaped to mate with the right edge of the first stationary staircase 132 at an interface 134 and include a second origination point "2" (see FIG. 1). Along the upper portion of the second stationary staircase 132 is a series of stationary steps 138 ascending from left to right and each including a riser 140 and a tread 142, except the highest stationary step 144 which has only a riser 140. Descending downward from the highest step 144 is a second ramp 146.

As best illustrated in FIG. 3, slidably joined to the second stationary staircase 132 is a second movable staircase 150 including a series of ascending movable steps 34 each having a riser 154, a tread 156, a spacer 158 between risers 154 and treads 156, and a descending ramp 160. The second movable staircase includes plate stiffeners 174, as well. The second movable staircase 150 is slidably joined to the second stationary staircase 132 with guides 92, guideways 94, and retainers 96. The guides 92 also limit downward movement of the movable staircase 150. However, the guideways 94 are positioned differently due to shape and space constraints.

Extending to the left from the second movable staircase 150 is a first lifter arm 166 having a rounded upper surface for sliding engagement with the triangularly shaped lifter 98 on the first movable staircase 70. Extending from the right side of the second movable staircase 150 is second lifter arm 170 of a different shape than the first lifter arm 166.

Referring to FIG. 2, the third staircase subassembly 180 is similar to the first two, having a base 182 and a third stationary staircase 184 with a left edge shaped to match the shape of the right edge of the second stationary staircase 132 and defining a third starting point "3" (see FIG. 1). The third series of stationary steps 190 is similar to the other stationary steps with risers 192 and treads 194 except that an intermediate ramp 198 is included to enhance play value and define a "short-cut" starting point at its lower end, designated by an asterisk in FIG. 1. Like the other staircases, the highest stationary step 200 has only a riser 192 and, instead of a tread, a descending ramp 202.

Referring to FIG. 3, a third movable staircase 206 includes a third series of movable steps 208 having risers 210, treads 212, and spacers 214. An intermediate movable ramp 218 is provided to correspond to the intermediate stationary ramp 198.

A lift member 220 extends from the left edge of the third movable staircase 206 to bear on the second lifter arm 170 of the second movable staircase 150, which mate with a sliding interface 172 descending from left-to-right.

Figure 5:
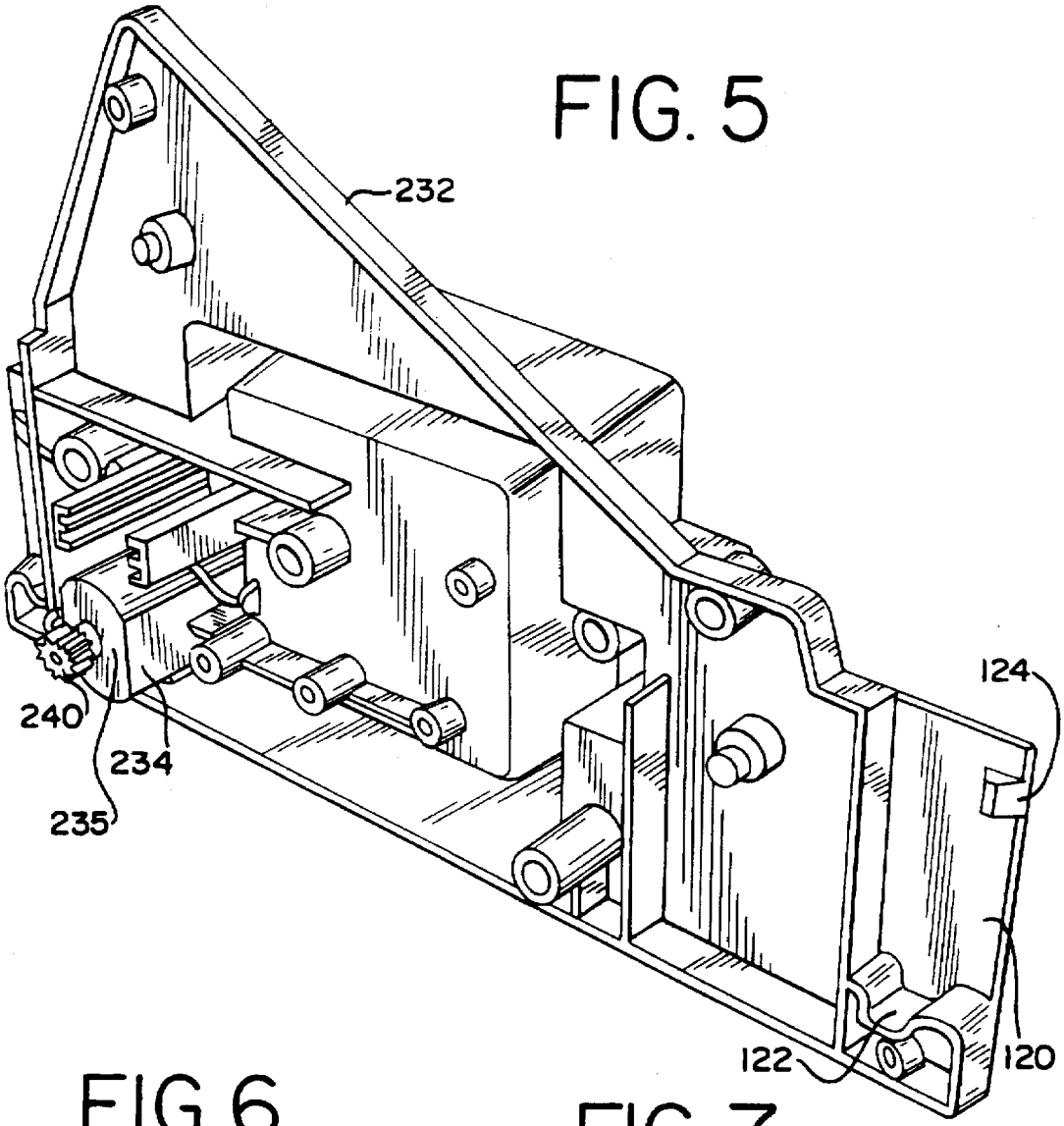
FIG. 5 is a perspective view of a rear housing cover.

With the staircase assembly 20 described to this point, it should be apparent that there are three main subassemblies 30, 34, and 38, each of which is connected to at least one other subassembly. Each subassembly includes a base, a stationary staircase, and a movable staircase. As described in detail below, the movable staircases reciprocate up and down on a slight angle to lift the characters 28 up serially from one stationary step over an adjacent stationary riser to the next stationary step until the characters 28 reach the slides where they are sent to a lower level. The mechanism 230 for reciprocating the movable staircases is illustrated in FIGS. 2, 3, and 5.

The reciprocating mechanism includes a housing 232 (FIG. 5), preferably positioned on the back side of the second staircase subassembly 34. A motor 234 is powered by batteries (not illustrated), and activated by an on-off switch 236 that extends through an opening on the second base 130 for easy access. (See FIG. 1)

The motor 234 is preferably a Mabuchi FA-130RA-18100 and includes a drive shaft 235. The motor 234 drives a speed-reducing gear mesh that begins with a spur pinion gear 240 fixed to the motor's drive shaft 235. Meshed to the spur pinion gear 240 is a first large idler gear 242 that is molded integrally and coaxially with a first small idler gear 244 which, of course, rotates at the same rate as the first large idler gear 242.

The first small idler gear 244 then is meshed with a second large idler gear 246 that is molded integrally and coaxially with a second small idler gear 248 to reduce rotational speed further.

The second small idler gear 248 is meshed with a third large idler gear 250 that is molded integrally with a mid-sized idler gear 252 which in turn is meshed with a large drive gear 254.

The large drive gear 254 includes a clutch 256 that interlocks with a cam 262. The cam includes a central clutch plate 260 that has recesses (not illustrated) for receiving keys (also not illustrated) formed in the large drive gear 254. The cam 262 is preferably molded integrally with the clutch plate 260, and extends outwardly and obliquely relative to a radius of the clutch plate 260. The clutch plate will disengage or be disengaged from the large drive gear 254 if the movable steps are prevented from moving in a normal reciprocating fashion.

As will be seen in FIGS. 2 and 3, the cam 262 rotates about two-thirds of a revolution without contacting anything on the staircase subassembly. When the cam 262 approaches the top of its rotation, it will engage a camming surface 268 on the back side of the second movable staircase 150. The camming surface 268 descends from left-to-right so that as the cam 262 proceeds upward the movable staircase 150 will move upward and slightly to the right as the guideways 94 are oriented. When the cam 262 disengages the camming surface 268, the upper side of the cam 262 will be brought into contact with the camming surface 268 by the weight of the second movable staircase 150, until the second movable staircase 150 is completely lowered. Cam 262 rotates clockwise at a preferred rate of 60 rotations per minute.

With this arrangement, the second movable staircase 150 will be raised and lowered with each revolution of the cam 262. Also, with each reciprocating motion of the second movable staircase 150, the first movable staircase 70 and the third movable staircase 206 will also move up and down because of their relationship with lifter arm 166 and lifter arm 170, respectively.

Further, with each reciprocation of the movable staircases, a character 28 straddling the stationary staircase will be lifted over the adjacent riser and then set on the next higher tread or onto one of the several slides.

Figure 6:
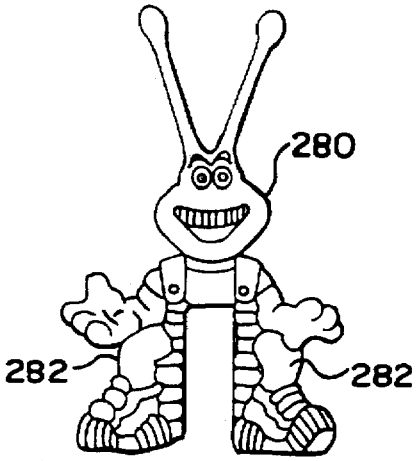
FIG. 6 is a front elevational view of a character for being transported on the staircase depicted in FIGS. 1 to 4.
Figure 7:
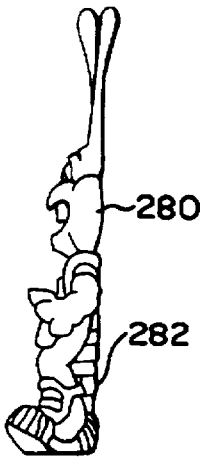
FIG. 7 is a side elevational view of the character in FIG. 6.

The characters 28 are shaped as illustrated in FIGS. 6 and 7 to resemble a stylized ant for use in a game in which the staircase assembly 20 is referred to as an "ant hill." The ant includes an upper body 280 and two spaced-apart lower legs 282 for straddling the staircase assembly 20. The legs 282 are sized such that the character 28 has a low center of gravity and will be maintained in an upright position as the movable staircases lift the character 28 up the stationary steps one at a time. Such a shape provides desirable play value over objects with transversely extending pegs that have been used to engage prior toy staircase assemblies.

A children's game can be played using the staircase apparatus ("ant hill") described above. Preferably, the game is played by two to four players with each player assigned five "ants" 28 of the same color.

With the ant hill motor turned on, a spinner 22 is used as a chance means to identify instructions the player should follow. The instructions are written on six pie-shaped spaces on the spinner 22. Alternatively, dice or cards could be used instead of the spinner 22. The numbers one, two, and three are on three of the spaces; and "short-cut," "sleeping ant," and "ant eater" are on the other three spaces. If the player spins a one, two, or three, that player places one of her ants on the portion of the ant-hill bearing that number. If the spinner lands on "short-cut," one of the player's ants is moved to the spot near the end of the ant hill marked "*" (see FIGS. 1). Spinning a "sleeping ant" causes a player to lose one turn while spinning "ant eater" permits one player to remove one ant of another player from the ant hill.

If all of one player's ants are on the ant hill, that player continues to spin in turn and may move an ant ahead on the ant hill if the spin allows. The winner of the game is the first player whose ants all slide down the finish ramp at the end.

The foregoing detailed description is provided for clearness of understanding only and should not be understood to add unnecessary limitations to the claims herein.

What is claimed is:

1. A game for use with a toy staircase assembly comprising:

a base;

a stationary staircase joined to and extending upwardly from the base, having a starting position and a plurality of stationary stairs ascending from a lower portion of the stationary staircase to a higher portion of the stationary staircase, each stationary stair including a riser and a tread;

a movable staircase operatively joined to and adjacent the stationary staircase, and having a plurality of movable stairs ascending from a lower portion of the movable staircase to a higher portion of the movable staircase, each movable stair comprising a riser and a tread;

a plurality of objects each having means for straddling the stationary staircase and the movable staircase simultaneously, and for sitting on a tread of a stationary stair and a tread of a movable stair;

reciprocating means for raising the movable staircase to engage an object sitting on a tread of a stationary stair with a movable stair to raise the object over the riser of an adjacent higher stationary stair, and for lowering the movable staircase to set the object on the tread of an adjacent higher stair;

means for activating the reciprocating means; and chance means for directing a player to make a move with instructions selected from the group comprising:

a) placing an object on the starting point of the staircase assembly;

b) skipping a turn; and c) removing an object of an opposing player from the staircase;

whereby game rules call for the reciprocating means to be activated, instruct each player to obtain a like number of objects having a distinctive feature, and, in turn, operate the chance means to obtain instructions for placing an object of that player on the starting position of the staircase assembly, skip a turn, or remove an opposing player's object from the staircase assembly, until all of the objects of a single player have ascended the entire staircase assembly to the end.

2. The game of claim 1 in which the reciprocating means comprises:

a motor mounted in the base;

a gear mesh rotationally joined to the motor; and a cam fixed to the gear mesh to rotate upward, engage a camming surface on the movable staircase, and rotate downward to disengage the camming surface of the movable staircase.

3. The game of claim 1 in which the reciprocating means comprises:

an inclined slot guide way having a lower first end and a higher second end; and a guide fixed to the stationary staircase and disposed in the guide way for guiding the movable staircase forward when being raised and for guiding the movable staircase rearward when being lowered.

4. The game of claim 1 in which the stationary staircase further comprises:

a slide descending from the higher second portion of the stationary staircase, and having means for slidably receiving an object from the movable staircase.

5. The game of claim 4, and further comprising:

a second base;

a second stationary staircase joined to and extending upward from the second base and coplaner with the slide of the stationary staircase, the second stationary staircase having a second starting position and a plurality of stationary stairs ascending from a lower first portion to a higher second portion, each stationary stair including a riser and a tread;

a second movable staircase operatively joined to the second stationary staircase, and having a plurality of movable stairs ascending from a lower first portion of the second movable staircase to and upper second portion of the second movable staircase, each movable stair including a riser and a tread; and reciprocating means for raising the second movable staircase to engage an object with a movable stair to raise the object over the riser of an adjacent higher stationary stair on the second stationary staircase, and for lowering the second movable staircase to set the object on the tread of the adjacent higher stationary stair.

6. The game of claim 5 in which the reciprocating means for raising and lowering the movable staircase comprises:

a lift means joined to the movable staircase; and a lever extending from the second movable staircase and bearing on the lift means of the movable staircase;

a cam for raising and lowering the lever; and means for rotating the cam.

7. The game of claim 5 in which the chance means further comprises an instruction for placing an object on the second starting point of the staircase assembly.

8. The game of claim 5 in which the second stationary staircase further comprises:

a second slide descending from the higher second portion of the second stationary staircase, and having means for slidably receiving an object from the second movable staircase.

9. The game of claim 8, and further comprising:

a third base;

a third stationary staircase joined to and extending upward from the third base and coplaner with the second slide of the second stationary staircase, the third stationary staircase having a third starting position and a plurality of stationary stairs ascending from a lower first portion to a higher second portion, each stationary stair including a riser and a tread;

a third movable staircase operatively joined to the third stationary staircase, and having a plurality of movable stairs ascending from a lower first portion of the third movable staircase to a higher second portion of the third movable staircase, each movable stair including a riser and a tread; and reciprocating means for raising the third movable staircase to engage an object sitting on the tread of a stationary stair with a movable stair to raise the object over the riser of an adjacent higher stationary stair, and for lower the third movable staircase to set the object on the tread of an adjacent higher stair.

10. The game of claim 9 in which the reciprocating means for raising and lowering the third movable staircase comprises:

a lift means joined to the third movable staircase;

a second lever extending from the second movable staircase and bearing on the lift means of the third movable staircase;

a cam for raising and lowering the second lever; and means for rotating the cam.

11. The game of claim 9 in which the chance means further comprises an instruction for placing an object on the third starting point of the staircase assembly.

12. The game of claim 5 in which the third stationary staircase further comprises:

a third slide descending from the higher portion of the third stationary staircase, and having means for slidably receiving an object from the second movable staircase.

13. The game of claim 1 in which the chance means further comprises an instruction for placing an object on a stationary stair closer to the second portion than the starting point.

14. A toy staircase assembly comprising:

a first staircase subassembly;

a second staircase subassembly joined to the first staircase subassembly;

each staircase subassembly comprising:

a base;

a stationary staircase joined to the base, having a plurality of stationary stairs ascending from a lower portion to a higher portion of the stationary staircase, and each stationary stair including a riser and a tread; and a movable staircase operatively joined to and adjacent the stationary staircase and having a plurality of movable stairs ascending from a lower portion to a higher portion of the movable staircase, each movable stair comprising a riser and a tread;

a descending slide coplaner with the stationary staircase of the first staircase subassembly and having means for receiving an object from the movable staircase of the first movable staircase assembly and slidably transferring an object downward to a lower portion of the second staircase subassembly; and reciprocating means for raising the movable staircases to engage an object sitting on a tread of a stationary stair, lifting the object over a riser of an adjacent and higher stationary stair, and for lowering the movable staircases to set the object on the tread of the adjacent and higher stair.

15. The toy staircase of claim 14 in which the reciprocating means for raising and lowering the movable staircases comprises:

a motor mounted in the base of the second staircase subassembly;

a gear mesh rotationally joined to the motor;

a cam fixed to rotate upward and raise a movable staircase of the second subassembly and rotate downward to lower the second movable staircase; and means for raising and lowering the movable staircases of the first and second staircase subassemblies in unison with the movable staircase of the second subassembly.

16. The toy staircase assembly of claim 14 in which each of the staircase subassemblies further comprises:

an inclined guideway ascending from the rear portion to the front portion of each movable staircase; and a fixed pin slidably disposed in the guideway for guiding the movable staircase forward when being raised and rearward when being lowered.

17. The toy staircase assembly of claim 14, and further comprising:

a third staircase subassembly joined to the second staircase subassembly, the third staircase subassembly comprising:

a third base;

a third stationary staircase joined to the base, having a plurality of stationary stairs ascending from a lower portion to a higher portion, and each stationary stair including a riser and a tread; and a movable staircase operatively joined to and adjacent the third stationary staircase and having a plurality of movable stairs ascending from a lower portion to a higher portion of the movable staircase, each movable stair comprising a riser and a tread; and reciprocating means for raising and lowering the third movable staircase.

18. The toy staircase assembly of claim 17, in which the reciprocating means comprises:

a lift means fixed to the third movable staircase; and a lever means fixed to the movable staircase of the second staircase subassembly and having means for engaging the lift means to raise and lower the third movable staircase in unison with the second movable staircase.

19. The toy staircase assembly of claim 14, and further comprising:

a plurality of starting points on the first and second stationary staircase assemblies;

chance means for directing a player to make a move with instructions selected from the group comprising:

a) placing an object on one of the starting points;

b) skipping a turn; and c) removing an object of an opposing player from the staircase assembly.

20. A toy staircase assembly comprising:

a base;

only one stationary staircase plate joined to and extending upwardly from the base, having a plurality of stationary stairs ascending from a lower portion of the stationary staircase to a higher portion of the stationary staircase, each stationary stair including a riser and a tread;

only one movable staircase plate operatively joined to and adjacent the stationary staircase, and having a plurality of movable stairs ascending from a lower portion of the movable staircase to a higher portion of the movable staircase, each movable stair comprising a riser and a tread;

an object having means for straddling the stationary staircase and the movable staircase simultaneously, and for sitting on a tread of a stationary stair and a tread of a movable stair; and reciprocating means for raising the movable staircase to engage the object sitting on a tread of a stationary stair with a movable stair to raise the object over the riser of an adjacent higher stationary stair, and for lowering the movable staircase to set the object on the tread of an adjacent higher stair.

21. The toy staircase assembly of claim 20 in which the reciprocating means comprises:

a motor mounted in the base;

a gear mesh rotationally joined to the motor; and a cam fixed to the gear mesh to rotate upward, engage a camming surface on the movable staircase, and rotate downward to disengage the camming surface of the movable staircase.

22. The toy staircase assembly of claim 20 in which the reciprocating means comprises:

an inclined slot guideway having a lower first end and a higher second end; and a guide fixed to the stationary staircase and disposed in the guideway for guiding the movable staircase forward when being raised and for guiding the movable staircase rearward when being lowered.

23. The toy staircase assembly of claim 20 in which the stationary staircase further comprises:

a slide descending from the higher portion of the stationary staircase, and having means for slidably receiving an object from the movable staircase.

24. The toy staircase assembly of claim 20, and further comprising:

a second base;

a second single stationary staircase joined to and extending upward from the second base and coplaner with the slide of the stationary staircase, the second stationary staircase having a plurality of stationary stairs ascending from a lower portion to a higher portion, each stationary stair including a riser and a tread;

a second single movable staircase operatively joined to the second stationary staircase, and having a plurality of movable stairs ascending from a lower portion of the second movable staircase to and upper portion of the second movable staircase, each movable stair including a riser and a tread; and reciprocating means for raising the second movable staircase to engage the object with a movable stair to raise the object over the riser of an adjacent higher stationary stair on the second stationary staircase, and for lowering the second movable staircase to set the object on the tread of the adjacent higher stationary stair.

25. The toy staircase assembly of claim 24 in which the reciprocating means for raising and lowering the movable staircase comprises:

a lift means joined to the movable staircase; and a lever extending from the second movable staircase and bearing on the lift means of the movable staircase;

a cam for raising and lowering the lever; and means for rotating the cam.

26. The toy staircase assembly of claim 24 in which the second stationary staircase further comprises:

a second slide descending from the higher portion of the second stationary staircase, and having means for slidably receiving an object from the second movable staircase.

27. The toy staircase assembly of claim 24, and further comprising:

a third base;

a third single stationary staircase joined to and extending upward from the third base and coplaner with the second slide of the second stationary staircase, the third stationary staircase having a plurality of stationary stairs ascending from a lower portion to a higher portion, each stationary stair including a riser and a tread;

a third single movable staircase operatively joined to the third stationary staircase, and having a plurality of movable stairs ascending from a lower portion of the third movable staircase to a higher portion of the third movable staircase, each movable stair including a riser and a tread; and reciprocating means for raising the third movable staircase to engage an object sitting on the tread of a stationary stair with a movable stair to raise the object over the riser of an adjacent higher stationary stair, and for lower the third movable staircase to set the object on the tread of an adjacent higher stair.

28. The toy staircase assembly of claim 27 in which the reciprocating means for raising and lowering the third movable staircase comprises:

a lift means joined to the third movable staircase;

a second lever extending from the second movable staircase and bearing on the lift means of the third movable staircase;

a cam for raising and lowering the second lever; and means for rotating the cam.

29. The toy staircase assembly of claim 27 in which the third stationary staircase further comprises:

a third slide descending from the higher portion of the third stationary staircase, and having means for slidably receiving an object from the second movable staircase.

* * * * *

UNITED STATES PATENT AND TRADEMARK OFFICE

CERTIFICATE OF CORRECTION

PATENT NO. : 5,676,374

DATED : October 14, 1997

INVENTOR(S) : Bossa et al.

It is certified that error appears in the above-identified patent and that said Letters Patent is hereby corrected as shown below:

On the title page, item
[54] "GAME APPARATS" should be --GAME APPARATUS--

Column 1, Line 1, "GAME APPARATS" should be --GAME APPARATUS--

Signed and Sealed this

Twenty-sixth Day of May, 1998

*Attest:*

Bruce Lehman

BRUCE LEHMAN

*Attesting Officer*

*Commissioner of Patents and Trademarks*